US008624805B2

(12) United States Patent
McCreary

(10) Patent No.: US 8,624,805 B2
(45) Date of Patent: Jan. 7, 2014

(54) CORRECTION OF TFT NON-UNIFORMITY IN AMOLED DISPLAY

(75) Inventor: James Leo McCreary, Los Altos, CA (US)

(73) Assignee: Siliconfile Technologies Inc., Seoul (KR)

( * ) Notice: Subject to any disclaimer, the term of this patent is extended or adjusted under 35 U.S.C. 154(b) by 1009 days.

(21) Appl. No.: 12/389,273

(22) Filed: Feb. 19, 2009

(65) Prior Publication Data

US 2009/0213049 A1 Aug. 27, 2009

Related U.S. Application Data

(60) Provisional application No. 61/031,220, filed on Feb. 25, 2008, provisional application No. 61/104,983, filed on Oct. 13, 2008.

(51) Int. Cl.
*G09G 3/32* (2006.01)

(52) U.S. Cl.
USPC ..... 345/80

(58) Field of Classification Search
USPC ..... 315/169.3, 149; 345/76, 80
See application file for complete search history.

(56) References Cited

U.S. PATENT DOCUMENTS 7,259,521 B1 8/2007 Ritter
2002/0101172 A1* 8/2002 Bu ..... 315/169.3
2005/0110420 A1* 5/2005 Arnold et al. ..... 315/169.3
2005/0156836 A1 7/2005 Yoneyama et al.
2005/0200291 A1* 9/2005 Naugler et al. ..... 315/149
2006/0192111 A1 8/2006 Fuhrer et al.
2007/0069994 A1 3/2007 Takahashi
2007/0075939 A1 4/2007 Cho et al.
2007/0195020 A1* 8/2007 Nathan et al. ..... 345/76

OTHER PUBLICATIONS

PCT International Search Report and Written Opinion, PCT Application No. PCT/US 09/34735, Apr. 9, 2009.

* cited by examiner

*Primary Examiner* — Quan-Zhen Wang
*Assistant Examiner* — Tony Davis
(74) *Attorney, Agent, or Firm* — Kile Park Reed & Houtteman PLLC

(57) ABSTRACT

Sub-pixel current in an OLED display is forced to converge to a desired level regardless of the source of pixel current error. By using a feedback loop, the pixel transistor current is forced to be equal to a predetermined target current that is established by an analog control circuit. The predetermined target current is selected to generate the desired pixel transistor current through the sub-pixel, and can be set by setting a target voltage. The sub-pixels have a 3T cell structure including 3 TFTs, one TFT for connecting the data line to the storage capacitor, another TFT for driving the sub-pixel current, and still another TFT for connecting the OLED diode anode to the data line of the AMOLED panel. Thus, the feedback loop of the present invention (comprising Taps M and N of a resistor string, and an amplifier, a comparator, and digital logic) senses the pixel transistor current via the data lines of the AMOLED panel to compensate for Mura.

20 Claims, 12 Drawing Sheets

CORRECTION OF TFT NON-UNIFORMITY IN AMOLED DISPLAY

CROSS-REFERENCE TO RELATED APPLICATIONS

The present invention claim priority under 35 U.S.C. §119 (e) from U.S. Provisional Patent Application No. 61/031,220, entitled "Dynamic Calibration of Pixel Current Variation and Aging in AMOLED Display," filed on Feb. 25, 2008, and from U.S. Provisional Patent Application No. 61/104,983, entitled "Correction of TFT Non-Uniformity in AMOLED Display," filed on Oct. 13, 2008, the subject matters of both of which are incorporated by reference herein in their entirety.

BACKGROUND OF THE INVENTION

1. Field of the Invention

The present invention relates to calibration of current variations in the pixels/sub-pixels of an active matrix organic light-emitting diode (AMOLED) display caused by non-uniformity of thin-film transistors (TFTs) in the sub-pixels.

2. Description of the Related Arts

An OLED display is generally comprised of an array of organic light emitting diodes (hereafter referred to as "OLED diodes") that have carbon-based films deposited between two charged electrodes. Generally one electrode is comprised of a transparent conductor, for example, indium tin oxide (ITO). Generally, the organic material films are comprised of a hole-injection layer, a hole-transport layer, an emissive layer and an electron-transport layer. When voltage is applied to the OLED diode, the injected positive and negative charges recombine in the emissive layer and transduce electrical energy to light energy. Unlike liquid crystal displays (LCDs) that require backlighting, OLED displays are self-emissive devices—they emit light rather than modulate transmitted or reflected light. Accordingly, OLEDs are brighter, thinner, faster and lighter than LCDs, and use less power, offer higher contrast and are cheaper to manufacture.

An OLED display typically includes a plurality of OLED diodes arranged in a matrix form including a plurality of rows and a plurality of columns, with the intersection of each row and each column forming a pixel of the OLED display. An OLED display is generally activated by way of a current driving method that relies on either a passive-matrix (PM) scheme or an active-matrix (AM) scheme.

In a passive matrix OLED (PM OLED) display, a matrix of electrically-conducting rows and columns forms a two-dimensional array of picture elements called pixels. Sandwiched between the orthogonal column and row lines are thin films of organic material of the OLEDs that are activated to emit light when current is applied to the designated row and column lines. The brightness of each pixel is proportional to the amount of current applied to the OLED diodes of the pixel. While PM OLEDs are fairly simple structures to design and fabricate, they demand relatively expensive, current-sourced drive electronics to operate effectively and are limited as to the number of lines because only one line can be on at a time and therefore the PM OLED must have instantaneous brightness equal to the desired average brightness times the number of lines. Thus, PM OLED displays are typically limited to under 100 lines. In addition, their power consumption is significantly higher than that required by an active-matrix OLED. PM OLED displays are most practical in alpha-numeric displays rather than higher resolution graphic displays.

An active-matrix OLED (AMOLED) display is comprised of OLED pixels (that are each comprised of R, G, B sub-pixels) that have been deposited or integrated onto a thin film transistor (TFT) array to form a matrix of pixels that emit light upon electrical activation. In contrast to a PM OLED display, for which electricity is distributed row by row, the active-matrix TFT backplane acts as an array of switches coupled with sample and hold circuitry that control and hold the amount of current flowing through each individual OLED sub-pixel during the total frame time. The active matrix TFT array continuously controls the current that flows to the OLED diodes in each of the sub-pixels, signaling to each pixel how brightly to illuminate.

AMOLED displays require regulated current in each pixel to produce a desired brightness from the pixel. Ideally, the TFTs in the active matrix TFT array exhibit uniform electrical characteristics, so that the AMOLED display can be precisely controlled in a uniform manner. However, the TFTs in the AMOLED are typically fabricated with poly-silicon (p-Si) that is difficult to fabricate in a uniform manner. This is because p-Si is made by converting amorphous silicon (a-Si) to p-Si by laser annealing the a-Si to increase the crystal grain size. The larger the crystal grain size, the faster and more stable is the resulting semiconductor material. Unfortunately the grain size produced in the laser anneal step is not uniform due to a temperature spread in the laser beam. Thus, uniform TFTs are very difficult to produce and thus the current supplied by TFTs in conventional AMOLED displays is often non-uniform, resulting in non-uniform display brightness. TFT non-uniformity throughout the OLED display causes "Mura" (streaking or spots) in the OLED displays made with p-Si TFTs. In other words, TFTs may produce different OLED currents due to their non-uniformities from pixel to pixel, even if the same gate voltage is applied to the TFTs.

Another problem with AMOLED displays occurs due to aging of the material in the OLEDs. As the OLED diode in each sub-pixel ages with use, it becomes less efficient in converting current to light, i.e., the efficiency of light emission of the OLED diode decreases. Thus, as OLED diode current to light efficiency of the OLED material decreases with use (age), light emitted from an OLED diode in each sub-pixel for a given gate voltage applied to the drive TFTs of the OLED display also decreases. As a result, the OLED display emits less light for display than desired in response to a given gate voltage applied to the drive TFTs. In addition, since the OLED diodes on various parts of the AMOLED display do not age (are not used) equally in a uniform manner, OLED aging also causes non-uniformity in the OLED display.

SUMMARY OF THE INVENTION

According to various embodiments of the present invention, sub-pixel current in an AMOLED display is forced to converge to a desired level regardless of the source of pixel current error. This is accomplished by forcing pixel transistor current of each sub-pixel to converge to a value such that the pixel transistor current matches a predetermined target current that is established using an analog feedback control circuit, in order to correct Mura. By using a feedback loop, the pixel transistor current of each sub-pixel is forced to be equal to the predetermined target current. The predetermined target current is selected to generate the desired current through the OLED diode for each sub-pixel, and can be set by setting a target voltage. The feedback control circuit can be comprised of a single-sided transresistance amplifier, or a differential transresistance amplifier. At a high level, Mura calibration senses pixel transistor current and allows offset adjustments so that the pixel transistor current becomes equal to a target current.

The OLED sub-pixels have a so-called 3T cell structure including three TFTs, one TFT for connecting the data line to the storage capacitor in the OLED sub-pixel, another TFT (the pixel transistor) for driving the OLED diode in each sub-pixel, and still another TFT for connecting the OLED diode anode to the data line of the AMOLED panel so that the pixel transistor current can be measured for Mura calibration. Thus, the feedback loop of the present invention senses the pixel transistor current via the data lines of the AMOLED panel to correct Mura.

For Mura correction, an average RGB value corresponding to a target current is loaded onto the column digital-to-analog converters (DACs) driving the data lines of the AMOLED panel. Any deviation of the pixel transistor current from the target current causes Mura distortion (streaking or spotting) and is sensed by the feedback loop via the data line. The feedback circuit determines the offset value to be added to the average RGB value and needed in order to force the pixel transistor current to be equal to the target current. Such offset values are determined, pixel-by-pixel, for all the sub-pixels of the AMOLED panel, thereby obtaining calibration (offset) values needed for Mura correction for each sub-pixel of the AMOLED display.

The present invention has the advantage that the pixel transistor current is forced to converge to the desired current level simply by setting the predetermined target current, regardless of the cause of variations, inaccuracies, or non-uniformity in the sub-pixels. Mura calibration can be accurately performed by using such feedback circuitry.

BRIEF DESCRIPTION OF THE DRAWINGS

The teachings of the embodiments of the present invention can be readily understood by considering the following detailed description in conjunction with the accompanying drawings.

DETAILED DESCRIPTION OF EMBODIMENTS

The Figures and the following description relate to preferred embodiments of the present invention by way of illustration only. It should be noted that from the following discussion, alternative embodiments of the structures and methods disclosed herein will be readily recognized as viable alternatives that may be employed without departing from the principles of the claimed invention.

Reference will now be made in detail to several embodiments of the present invention(s), examples of which are illustrated in the accompanying figures. It is noted that wherever practicable similar or like reference numbers may be used in the figures and may indicate similar or like functionality. The figures depict embodiments of the present invention for purposes of illustration only. One skilled in the art will readily recognize from the following description that alternative embodiments of the structures and methods illustrated herein may be employed without departing from the principles of the invention described herein.

Figure 1:
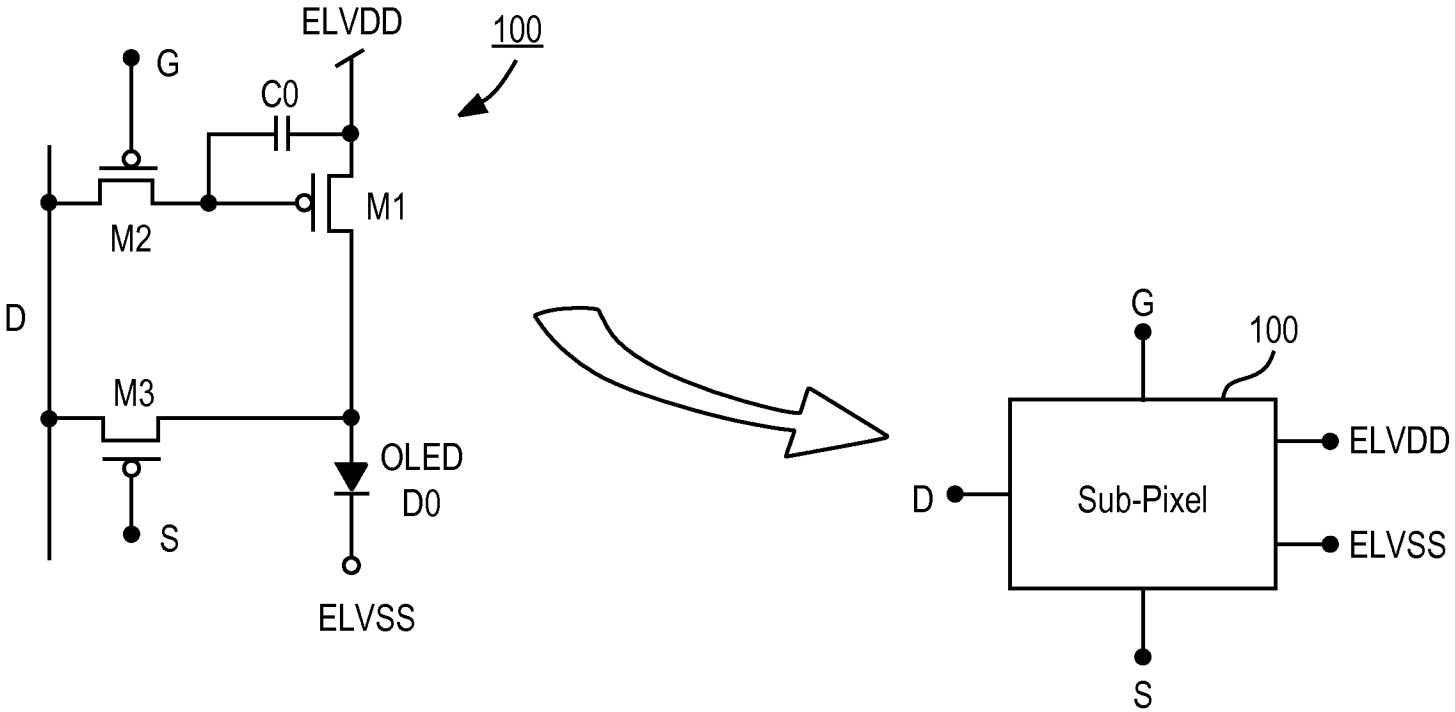
FIG. 1 illustrates a sub-pixel structure of an AMOLED display, according to one embodiment of the present invention.

FIG. 1 illustrates a sub-pixel structure of an AMOLED display, according to one embodiment of the present invention. For a color AMOLED display, each pixel includes 3 sub-pixels that have identical structure but emit different colors (R, G, B). For simplicity of illustration, FIG. 1 illustrates only one sub-pixel corresponding to one of the R, G, B colors per sub-pixel at the intersection of each row and each column of the AMOLED display panel. As shown in FIG. 1, the active drive circuitry of each sub-pixel 100 includes TFTs M1, M2, and M3 and a storage capacitor C0 for driving the OLED diode D0 of the sub-pixel. In the following explanation of FIG. 1 and ensuing figures, the type of the TFTs M1, M2, M3 is p-channel TFT. However, note that n-channel TFTs may also be utilized in the active matrix.

The source of TFT M2 is connected to data line D, and the drain of TFT M2 is connected to the gate of TFT M1 (the "pixel transistor") and to one side of storage capacitor C0. The source of TFT M1 is connected to positive supply voltage ELVDD. The other side of storage capacitor C0 is also connected, for example, to the positive supply voltage ELVDD and to the source of TFT M1. Note that the storage capacitor C0 may be tied to any reference electrode in the pixel, but the connection shown in FIG. 1 has performance benefits in the presence of ELVDD noise. The drain of TFT M1 is connected to the anode of the OLED diode D0. The cathode of the OLED diode D0 is connected to negative supply voltage ELVSS. The source of TFT M3 is connected to the anode of OLED diode D0, and the drain of TFT M3 is connected to data line D. The data line D voltages are downloaded to the AMOLED display a row at a time.

When TFT M2 is turned on, the analog gate voltage from the data line D is applied to the gate of each TFT M1 of each sub-pixel, which is locked by storage capacitor C0. In other words, the continuous current flow to the OLED diodes is controlled by the two TFTs M1, M2 of each sub-pixel. TFT M2 is used to start and stop the charging of storage capacitor C0, which provides a voltage source to the gate of TFT M1 at the level needed to create a constant current to the OLED diode. The TFT M2 samples the data on the data line D, which is then transferred to and held by the storage capacitor C0. The voltage held on the storage capacitor C0 is applied to the gate of the TFT M1. In response, TFT M1 drives current through the OLED diode D0 to a specific brightness depending on the value of the sampled and held voltage as stored in the storage capacitor C0.

In addition to the two TFTs M1, M2 typically found in conventional AMOLED cells ("2T cell structure"), the AMOLED sub-pixel of the present invention employs a "3T cell structure" that additionally includes a third TFT M3 with one additional control line S that can be used to control the gate voltage of TFT M3. As will be explained in more detail below, TFT M3, when turned on, enables either the current through OLED diode D0 or the current in pixel transistor M1 to be sensed via the data line D. Thus, the AMOLED display of the present invention uses "data line sensing" to sense either of these currents. As shown in FIG. 1, each sub-pixel 100 may be represented as a circuit block with 5 terminals, i.e., TFT M2 gate voltage G, data line voltage D, M3 gate voltage S, and ELVDD and ELVSS.

Figure 2:
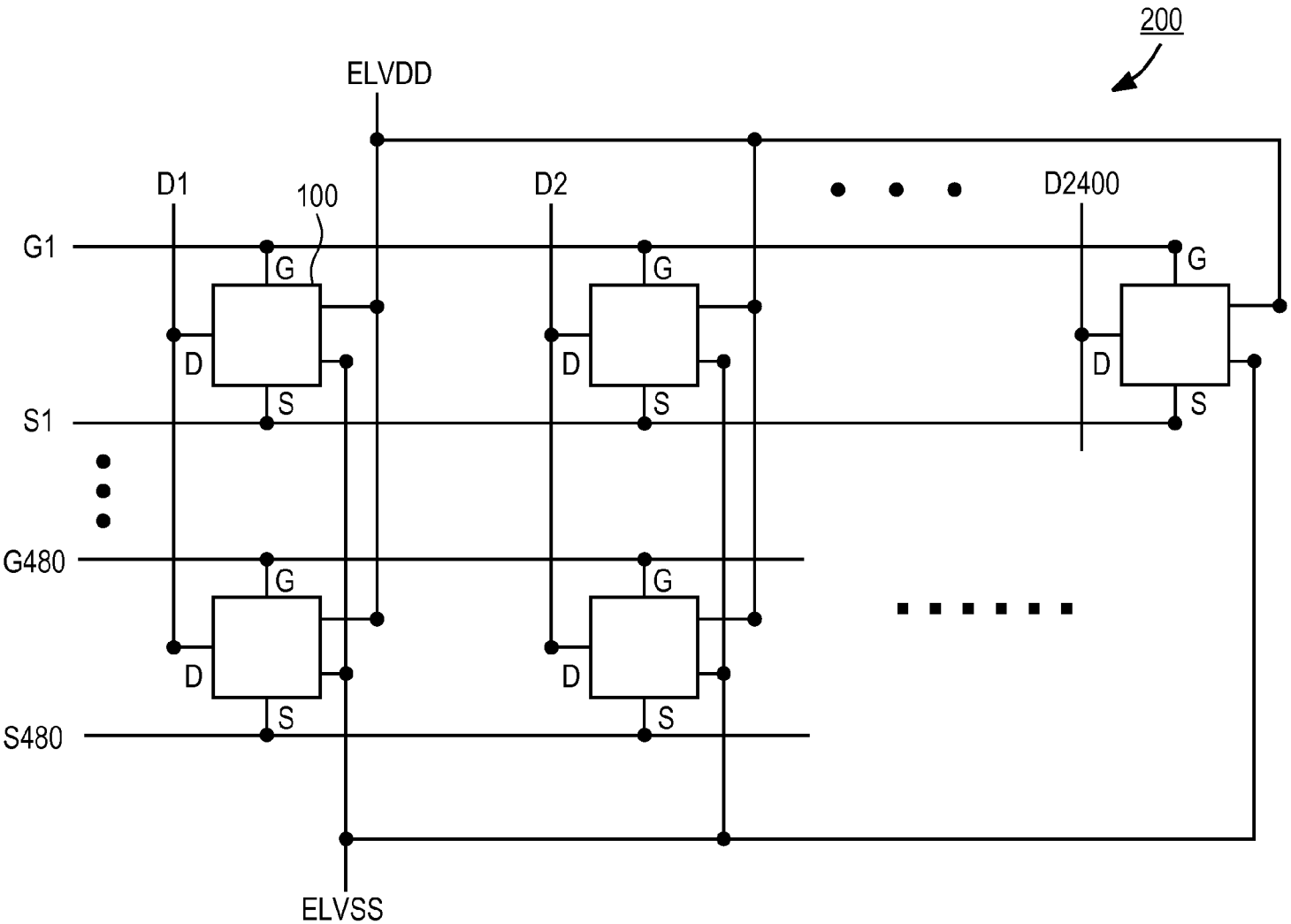
FIG. 2 illustrates the configuration of an AMOLED panel including OLED sub-pixels with the pixel structure of FIG. 1, according to one embodiment of the present invention.

FIG. 2 illustrates the configuration of an AMOLED display panel including OLED sub-pixels with the sub-pixel structure of FIG. 1, according to one embodiment of the present invention. The AMOLED display panel 200 is for a 480×800 RGB AMOLED. Each sub-pixel structure 100 corresponds to that shown in FIG. 1. Each of 3 sub-pixels is supplied by a dedicated data line D1, D2, . . . , D2400 corresponding to each of R, G, B. All the supply voltage lines corresponding to the 2400 columns (800 columns×3 colors) D1, D2, . . . , D2400 are powered by a common ELVDD supply voltage line. Thus, one column contains 3 data lines. Also note that one additional control line (S1, S2, . . . , S480) is added to each row, to control the TFTs M3 in each sub-pixel and achieve data line sensing of the OLED diode current or the pixel transistor current in each sub-pixel via the corresponding data lines D1, D2, . . . , D2400.

Figure 3:
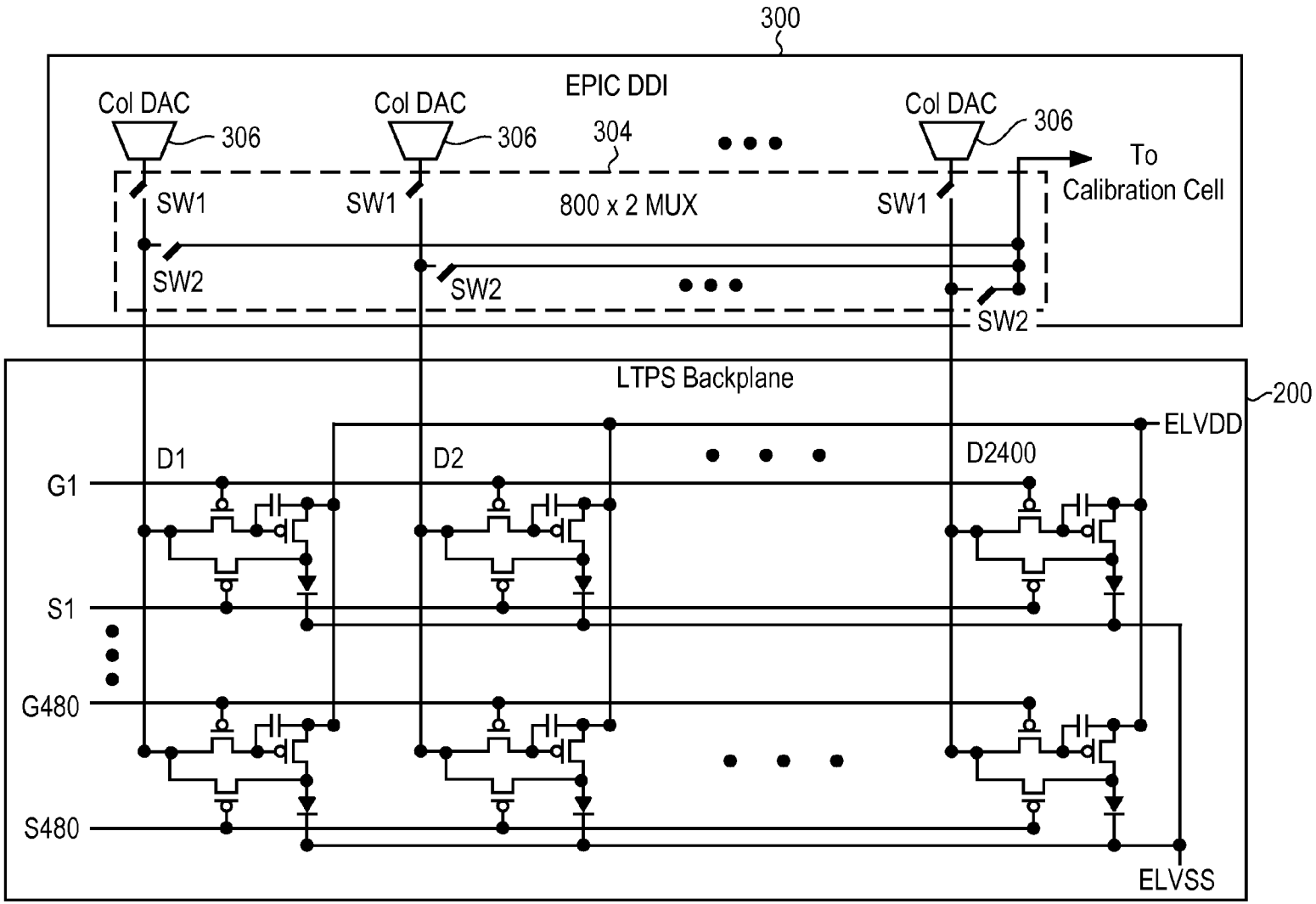
FIG. 3 illustrates an EPIC DDI (Electrical Pixel Correction Display Driver IC) driving an AMOLED panel, according to one embodiment of the present invention.

FIG. 3 illustrates a EPIC DDI (Electrical Pixel Correction Display Driver IC) driving an AMOLED panel 200, according to one embodiment of the present invention. EPIC DDI 300 includes 800 column DACs (Digital-to-Analog Converters) 306 corresponding to the data lines (D1, D2, . . . , D2400), in groups of 3, of the AMOLED panel 200 (LTPS backplane). Each of 800 column DACs 306 can address 3 data lines by using a 1-to-3 RGB MUX (not shown in FIG. 3). Thus all 2400 data lines D1, D2, . . . , D2400 can be addressed. An 800×2 multiplexer 304 is used to divert pixel current to a calibration circuit (not shown in FIG. 3 but shown in FIG. 4). Multiplexer 304 includes switches SW1, SW2 for each column. Switch SW1 connects or disconnects the column DAC 306 to/from the corresponding column, and switch SW2 connects or disconnects the calibration cell (not shown) to the corresponding column for sensing of pixel transistor current in the case of Mura correction (or for sensing of OLED diode current in the case of image sticking calibration) of each sub-pixel via the selected data line (D1, D2, . . . , D2400).

Figure 4:
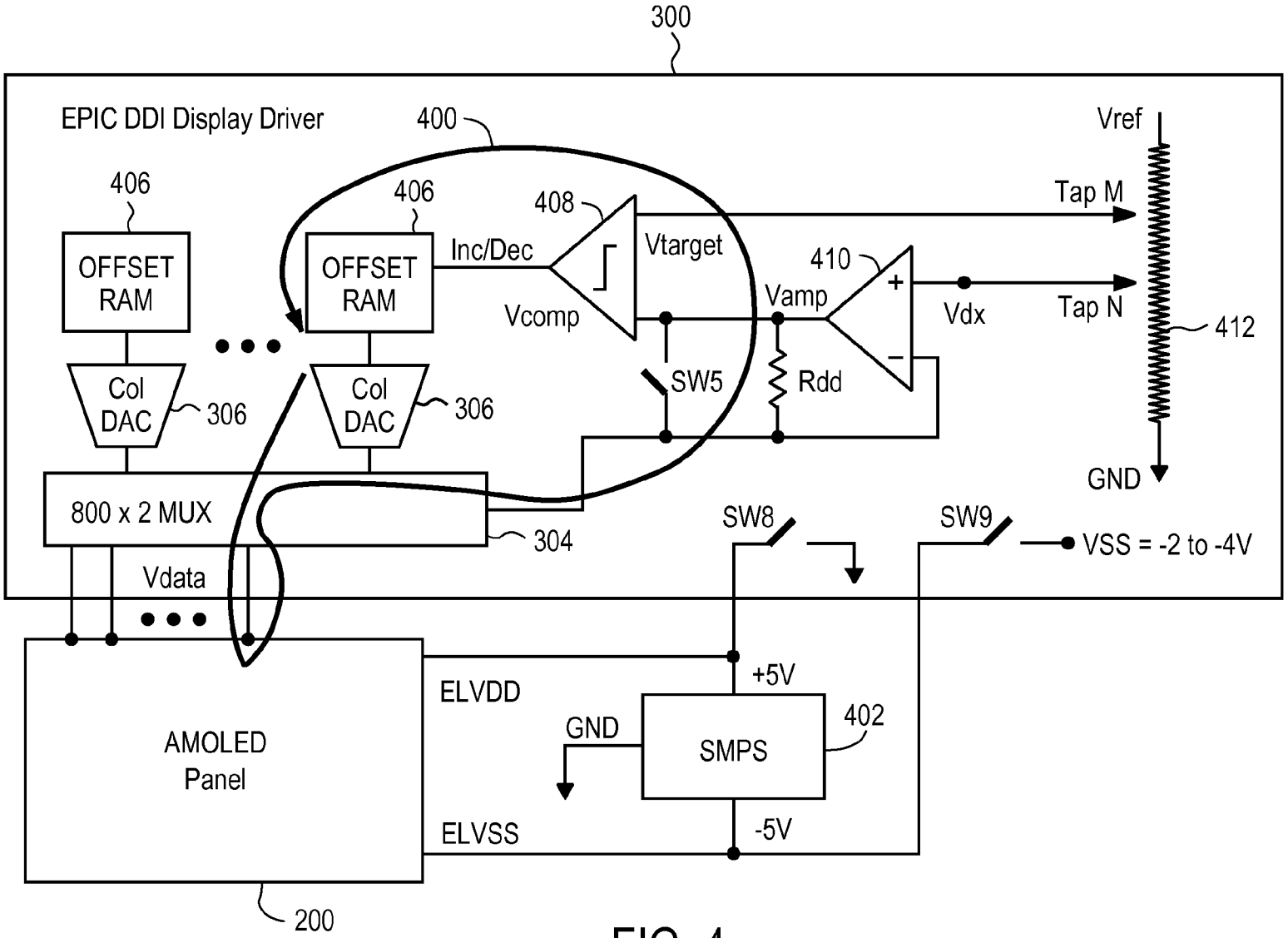
FIG. 4 illustrates the circuitry of the EPIC DDI in more detail, according to one embodiment of the present invention.

FIG. 4 illustrates the circuitry of the EPIC DDI in more detail, according to one embodiment of the present invention. As will be explained in more detail below with reference to FIGS. 6A through 6F, the EPIC DDI circuitry of FIG. 4 can be used to correct Mura (streaking or spotting) and aging of the OLEDs in the sub-pixels and other current variations. According to the circuitry in FIG. 4, either OLED diode current (in the case of image sticking calibration) or pixel transistor current (in the case of Mura calibration) in the sub-pixel is forced to converge to a desired level represented by the input voltage Vtarget at the comparator 408, regardless of the source of pixel current error. Vtarget can be selected to generate the desired current through the sub-pixel.

Switches SW1 (see FIG. 3) in MUX 304 connect each of 800 column DACs 306 to each of 800 columns of the AMOLED panel. Switches SW2 in MUX 304 allows each of the columns to be switched sequentially to a single calibration cell (see FIG. 4) comprised of amplifier 410, switch SW5, resistor Rdd, resistor string 412, comparator 408, offset RAM 406, etc., so that one calibration cell can be used to calibrate all the sub-pixels in the AMOLED panel 200. Although one calibration cell is used in the following description herein, multiple calibration cells may also be used to reduce Mura calibration time at the expense of the additional circuitry. Column DACs 306 drive Vdata voltage on the selected data lines (D1, D2, . . . , D2400) to be proportional to RGB display data. Offset RAMs 406 contain offset values that can be added to (or subtracted from) RGB data for calibration. As a result, column DACs 306 generate the Vdata voltage driving each pixel that is offset from an average RGB value by a unique amount corresponding to the offset values in the offset RAMS 406 so that the pixel transistor current is identical in each sub-pixel (of the same color) independent of pixel transistor variations or mismatches.

In the case of Mura calibration, the switches SW1 connect the column DACs 306 (through the RGB MUX not shown in FIG. 4) to the data lines (D1, D2, . . . , D2400) of the AMOLED panel 200. The non-inverting input to amplifier 410 is simultaneously set to the voltage Vdx. However, when switches SW2 in the MUX 304 connect the data lines to the calibration circuitry comprised of the amplifier 410, comparator 408, and resistor Rdd, etc., the current through the pixel transistors (not shown in FIG. 4) in the connected sub-pixel is sensed via resistor Rdd as the voltage Vamp at the output of feedback amplifier 410. Specifically, Vamp (more specifically, Vamp−Vdx) is proportional to data line current, which is proportional to pixel transistor current. Resistor string 412 is a Gamma DAC with taps at each gray level of the AMOLED display. Voltage Vdx at the positive input of amplifier 410 can be set by Tap N of resistor string 412. Voltage Vtarget at one input of comparator 408 can be set by Tap M of resistor string 412. During Mura calibration, both SW8 and SW9 are open and the SMPS (switched-mode power supply) 402 is turned off. Then both ELVDD and ELVSS are externally driven by a low-noise DC power supply that is equal to the ELVDD value of the SMPS 402. This prevents pixel current flow through the OLEDs.

Referring to FIG. 4, the output Vcomp of comparator 408 is used to increase or decrease (Inc/Dec) the values in the Offset RAMs 406, based on the value of Vtarget and Vamp. Vdata increases or decreases according to the values in the offset RAMs 406, and then this new value of Vdata is loaded onto the storage capacitors C0 of the corresponding sub-pixels via switches SW1 and this in turn increases or decrease pixel transistor current in the corresponding AMOLED sub-pixels. Such pixel transistor current is then sensed via its corresponding data line via switches SW2 in MUX 304 as voltage Vamp at the output of amplifier 410. Thus, a sampled-data feedback loop 400 is formed by this circuitry.

Comparator 408 compares Vtarget to Vamp. As will be explained further below, Vamp decreases as the pixel transistor current sensed via data lines D1, D2, . . . , D2400 increases. If Vtarget<Vamp initially, comparator 408 increments the DAC offset RAM value until Vtarget>Vamp as a result of multiple iterations of the feedback loop 400. If Vtarget>Vamp initially, comparator 408 decrements the DAC offset RAM until Vtarget<Vamp, as a result of multiple iterations of the feedback loop 400. The process converges when the comparator 408 output switches. In this manner, Vamp is forced to be equal to Vtarget regardless of variations, errors, etc. in the OLED sub-pixels, and thus the pixel transistor current represented by Vamp is forced to be equal to the target current value represented by the voltage Vtarget. Thus, after iterations converge, pixel transistor current in each sub-pixel can be precisely controlled and forced to a fixed value simply by setting Vtarget.

Note that, for simplicity of illustration of Mura calibration, FIG. 4 and FIGS. 6A through 6E show only the offset RAMs 406 as providing the digital input to the column DACs 306, and other components that would be present in actual implementations of the AMOLED panel are omitted in FIG. 4.

However, in actual implementation, the offset RAM 406 would be replaced by the combined circuitry including Mura offset RAM 706, aging offset RAM 704, Mura offset data scaler 718, aging offset data scaler 720, RGB input data 724, adder 722, together generating the compensated RGB data 702 for input to the column DACs 306, as shown and explained in more detail below with reference to FIG. 7. For Mura calibration, it is the Mura offset RAM 706 whose values are calibrated (incremented or decremented) based on the outputs from the Vcomp comparator 408 by operation of the feedback loop 400.

Note that during Mura calibration of the OLED pixels at the factory, the SMPS ELVDD voltage is measured, and then the SMPS 402 (which powers the AMOLED in normal operation) is turned off. For Mura calibration, ELVDD voltage is then supplied to the AMOLED panel 200 by a low-noise supply (not shown herein), and the ELVSS pin is forced to the same voltage as ELVDD, ensuring that the OLED diode current is zero. For image sticking calibration in the field, ELVDD is driven to GND by switch SW8, and ELVSS is driven by VSS, an adjustable regulator, to a voltage (−2 to −4 volt) by switch SW9, thus ensuring that with the appropriate gate voltage on TFT M1 the pixel transistor current is zero.

Figure 5:
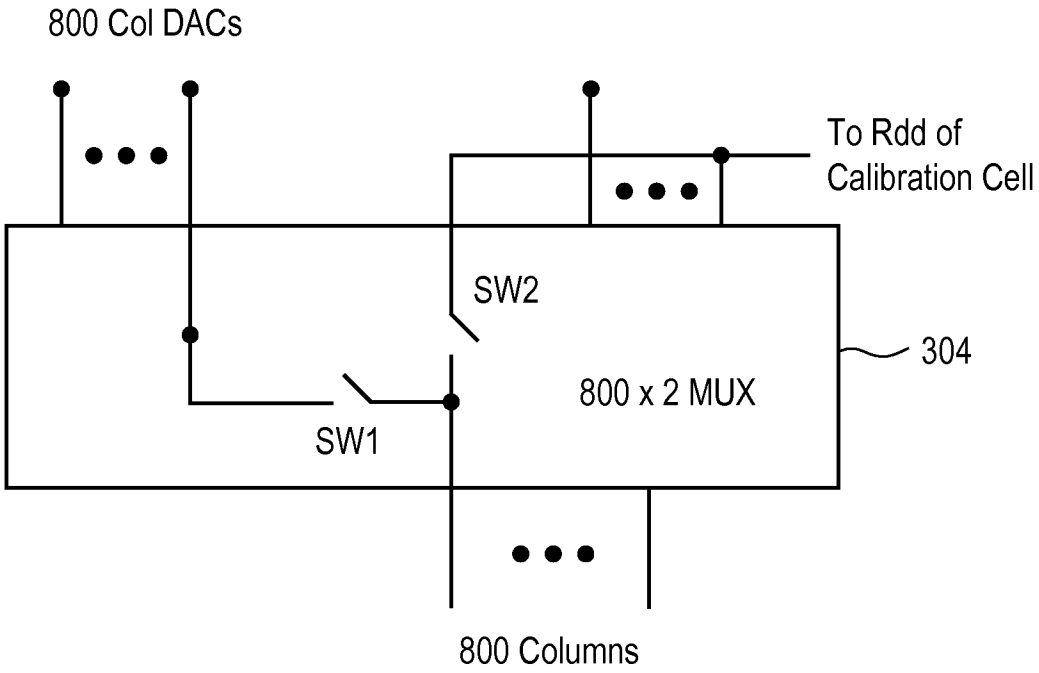
FIG. 5 illustrates the multiplexer in the EPIC DDI of FIG. 4 in more detail, according to one embodiment of the present invention.

FIG. 5 illustrates the multiplexer (MUX) 304 in the EPIC DDI of FIG. 4 in more detail, according to one embodiment of the present invention. As shown in FIG. 5, the MUX 304 has two switches, SW1 and SW2 corresponding to each of the 800 columns of the AMOLED. MUX 304 connects the column DAC 306 to the corresponding column for normal operation using switch SW1, and connects a selected column to the calibration circuitry (resistor Rdd in FIG. 4) for pixel transistor current measurement in the feedback loop 400 for calibration using switch SW2.

FIGS. 6A, 6B, 6C, 6D, and 6E illustrate how the EPIC DDI of FIG. 4 compensates for Mura distortion in the AMOLED display, according to one embodiment of the present invention. As mentioned above, in order to simplify the Mura calibration explanation, the RGB input 724, offset scalers 718 and 720, adder 722 and compensated RGB data register 724 at the input of each column DAC 306 are omitted in FIGS. 6A, 6B, 6C, 6D, and 6E. Capacitor CL and resistor RL represent the parasitic capacitance and parasitic resistance, respectively, present on each data line and can be assumed to be equal for all data lines.

Figure 6A:
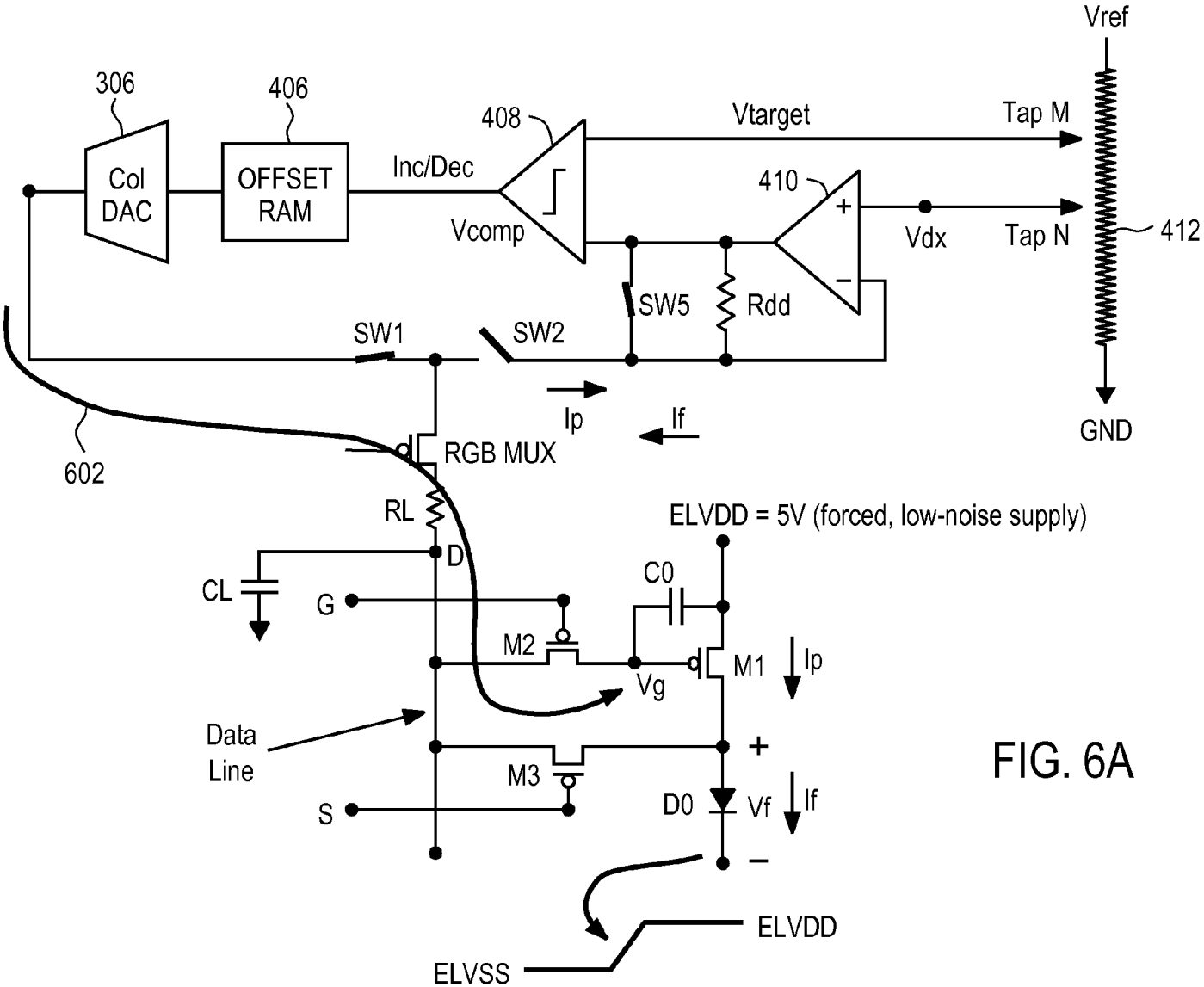
FIGS. 6A, 6B, 6C, 6D, and 6E illustrate how the EPIC DDI of FIG. 4 compensates for Mura distortion in the AMOLED display, according to one embodiment of the present invention.

The first step of Mura calibration is to store an average RGB value on the pixel storage capacitors C0, as shown in FIG. 6A. Here, the "average RGB value" is the analog equivalent of the "average RGB data" (when converted to analog) which produces a pixel transistor current equal to Itarget (e.g., 200 nA) in all pixels, which could have been measured in the factory empirically. Loading such average RGB value onto the OLED pixels prior to Mura calibration reduces the time required for Mura calibration.

Referring to FIG. 6A, the ELVSS pin is set to ELVDD for Mura calibration operations. Tap N of resistor string 412 is set to a nominal data line voltage (+2V) at Vdx for pixel transistor current measurement for Mura calibration operations. Then, the "average RGB data" is loaded into column DAC 306 (for the 1st bit of Mura offset calibration), and the offset RAM 406 value is set to zero (0) only for the 1st bit of the Mura calibration offset value of a pixel that is being calibrated. For all other bits of Mura calibration, the offset RAM 406 will begin with the previous value set during calibration of the previous bit. Thereafter, switch SW2 is opened and switches SW1 and SW5 are closed as shown in FIG. 6A. Also, TFT M3 is turned off, and TFT M2 is turned on. Then, the RGB MUX is selected to connect the corresponding column to one of the three data lines connected to the sub-pixel that is to be calibrated. Note that this step of selecting the RGB MUX is performed because there are 3 sub-pixels each corresponding to colors R, G, B, in a pixel, but does not directly affect the calibration process. For the purposes of illustration of Mura calibration according to the present invention, each sub-pixel may be treated like a single, independent OLED pixel.

Next, since TFT M2 is on, the column DAC 306 voltage (which is set to the average RGB value) applied to the connected data line D is also applied as the gate voltage Vg to TFT M1, as shown in arrow 602, and the voltage Vg settles on data line D. Then, TFT M2 is turned off, and the pixel voltage corresponding to the voltage Vg settles on storage capacitor C0. As a result, charges corresponding to the average RGB value are stored in the pixel storage capacitor C0 of the calibrated sub-pixel.

Figure 6B:
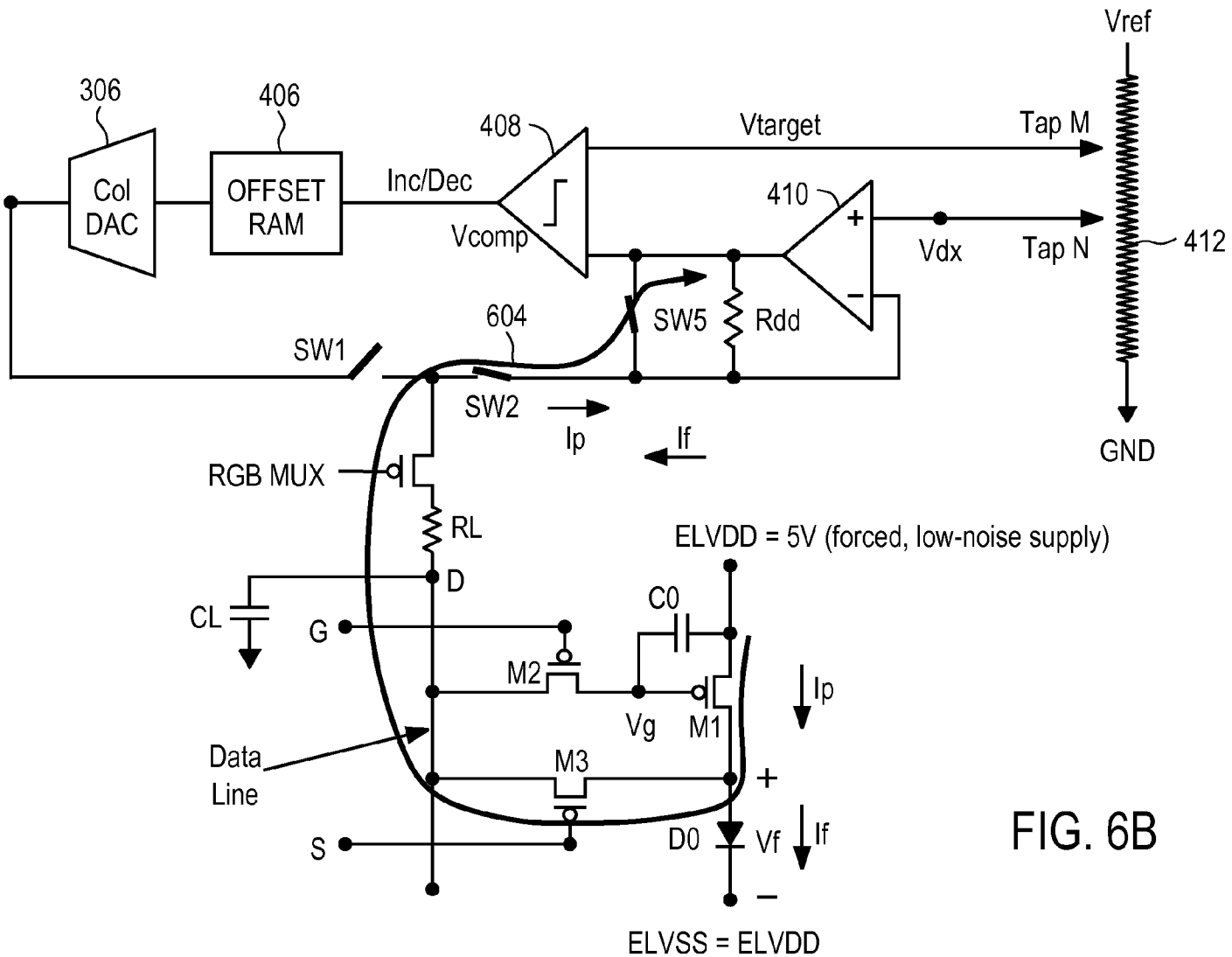

The second step of Mura calibration is to pre-charge the data line D to the voltage Vdx set by Tap N of the resistor string 412, as shown in FIG. 6B. Continuing from FIG. 6A, TFT M2 is turned off, switch SW1 is opened, and switches SW2 and SW5 are closed. Also, TFT M3 is turned on by applying a turn-on voltage to the gate of TFT M3 on the sense line S. Next, Vtarget is set to Vtarget=Vdx−Itarget×Rdd where Itarget=200 nA (for example). Closing switch SW5 forces the voltage on data line D to settle quickly to Vdx.

Figure 6C:
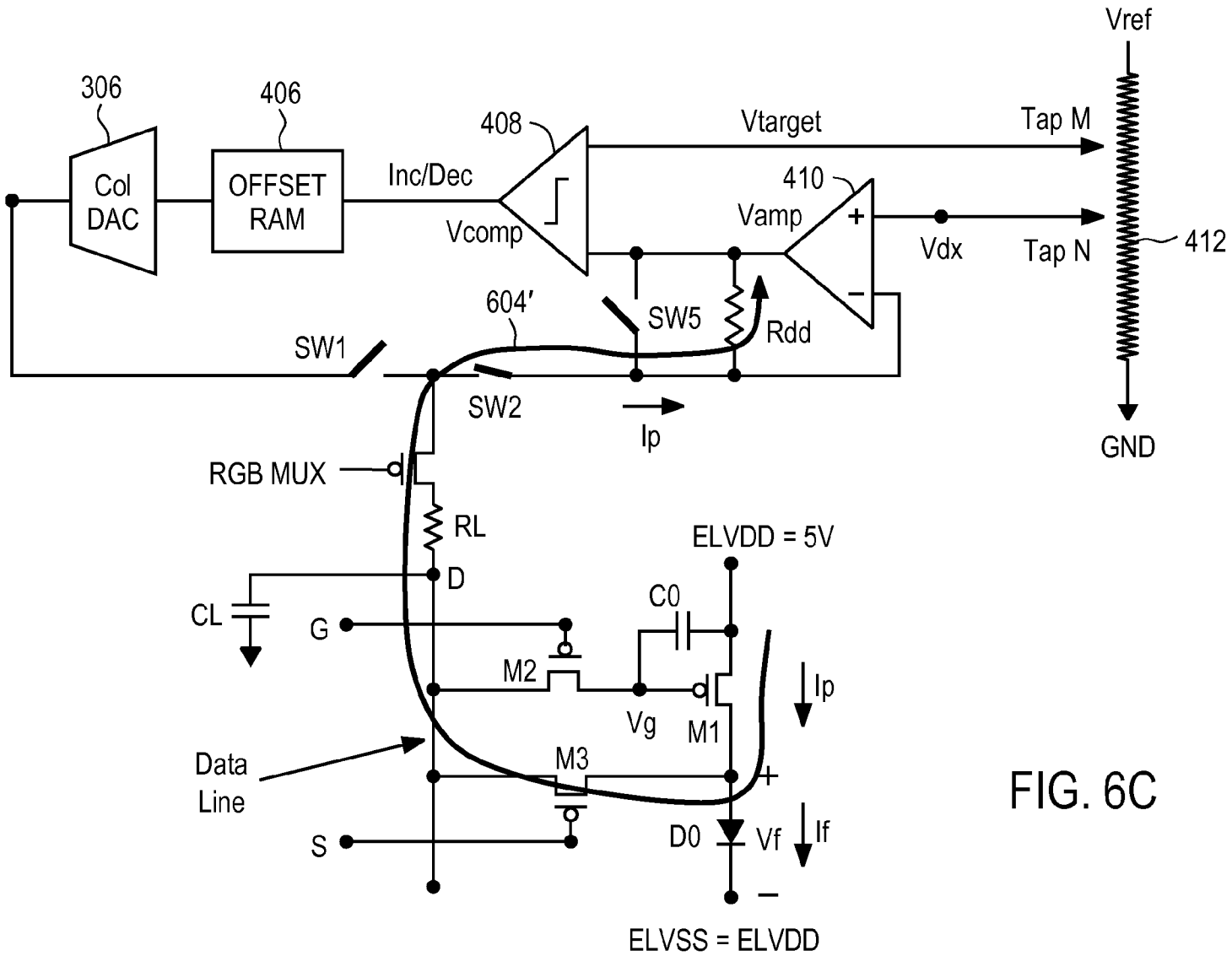

The third step of Mura calibration is to measure the pixel transistor current and determine the 1st bit of the offset RAM 406 value for calibration based on the measured pixel transistor current, as shown in FIG. 6C. To this end, switch SW5 is opened, which causes the pixel transistor current Ip to flow from TFT M1, through TFT M3, through resistor RL on data line D, and through resistor Rdd in the calibration circuitry. The output voltage Vamp of amplifier 410 becomes Vamp=Vdx−Ip×Rdd. That is, the larger the pixel transistor current Ip, the smaller the output voltage Vamp of amplifier 410. Using Comp to denote the logical output of comparator 408, if Comp=0, then Vtarget>Vamp, which means the pixel transistor current Ip is larger than the desired current Itarget as represented by the voltage Vtarget and thus the strobed or clocked comparator 408 decrements the offset value ($1^{st}$ bit) in offset RAM 406. If Comp=1, then Vtarget<Vamp, which means the pixel transistor current Ip is smaller than the desired current Itarget as represented by the voltage Vtarget and thus the strobed or clocked comparator 408 increments the offset value ($1^{st}$ bit) in offset RAM 406. This comparison process by comparator 408 occurs once per each bit of the offset value. As a result, the offset RAM 406 contains the value of the 1st bit of Mura calibration (this value can be positive or negative).

Figure 6D:
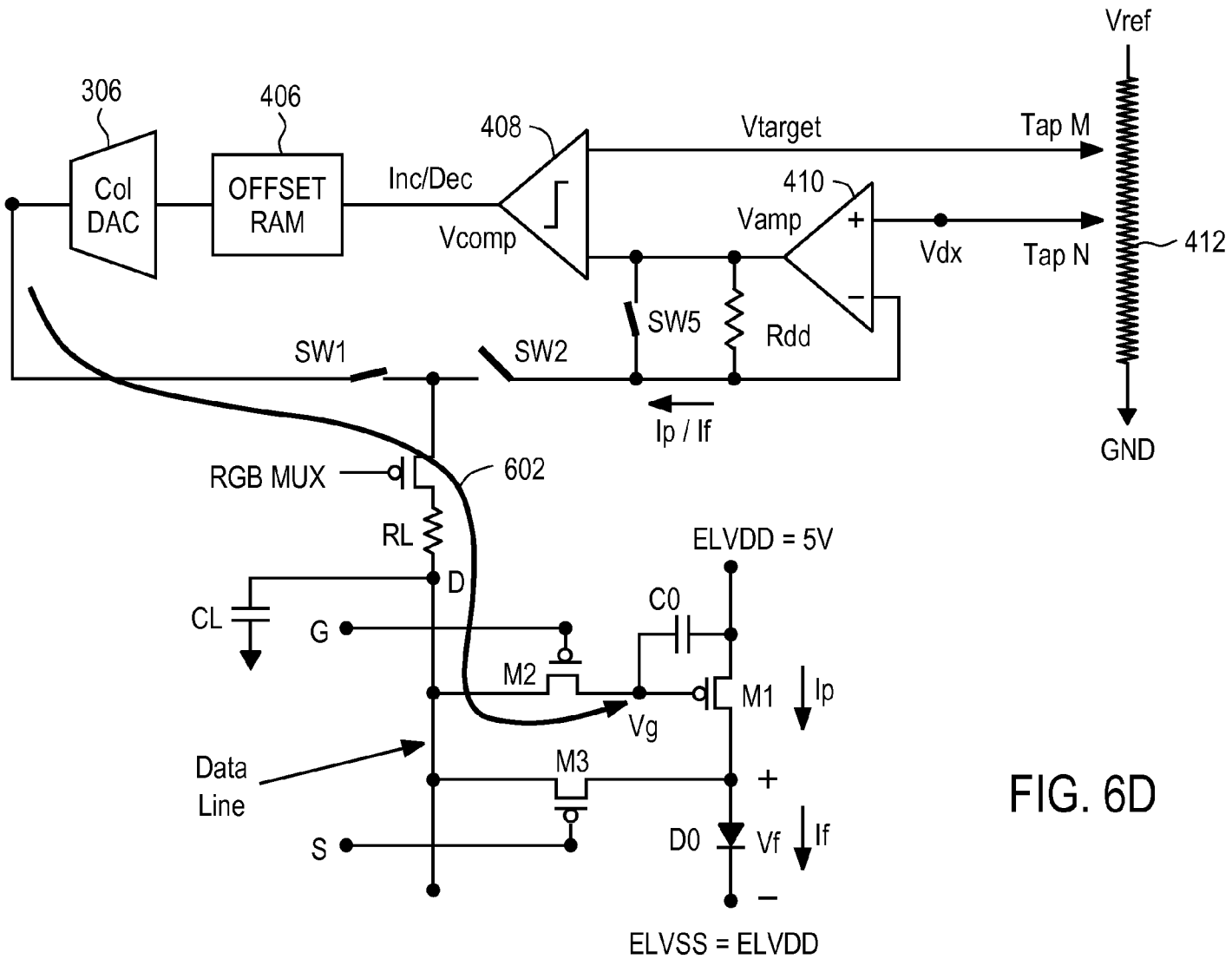

The next step of Mura calibration is to add the average RGB data to the offset RAM 406 data and to apply this sum to the column DAC 306 digital input. This action changes the DAC 306 output and this new value is then transferred onto the storage capacitor C0 of the OLED sub-pixel. The second bit of the offset value for Mura calibration can now be determined. Referring to FIG. 6D, the updated column DAC 306 value (reflecting the $1^{st}$ bit of the offset RAM 406 data determined with reference to FIG. 6C added to the average RGB data) is loaded onto storage capacitor C0 via path 602, by turning TFT M3 off and TFT M2 on, opening switch SW2 and closing switches SW1 and SW5, and selecting the same RGB MUX (for the same pixel). As a result, the modified column DAC 306 voltage quickly settles on the data line D, is applied as the gate voltage Vg of TFT M1, and is stored in the storage capacitor C0. Then, TFT M2 is turned off. Then, the same processes as explained with reference to FIGS. 6B and 6C are performed to sense the pixel transistor current Ip via path 604' and determine the second bit of the offset RAM 406 value for Mura calibration.

The processes described in FIGS. 6A through 6D are repeated to obtain the subsequent bits of the offset RAM 406 data until the maximum number of bits of the offset RAM for Mura calibration are determined (for SAR search) or the comparator 406 switches (for proximity search, which is a linear sequential search). Such final value of the offset RAM 406 is stored in the Mura offset RAM (706 in FIG. 7) location for the 1st pixel, and as a result the 1st pixel Mura calibration is complete. Then, staying on the same data line D, the calibration process of FIGS. 6A through 6D is repeated, traversing down the same column as in the first calibrated pixel, until all pixels in that column have been calibrated and their offsets are stored into their corresponding locations in the offset RAM 406. Then, the calibration process of FIGS. 6A through 6D is repeated, proceeding to the next column and so on, until all pixels in all columns have been calibrated for Mura or streaking. As a result, Mura calibration is complete, and ELVSS and ELVDD voltages are reset for normal operation of the AMOLED display. Either successive approximation (SAR search) or linear search could be used during calibration.

Figure 6E:
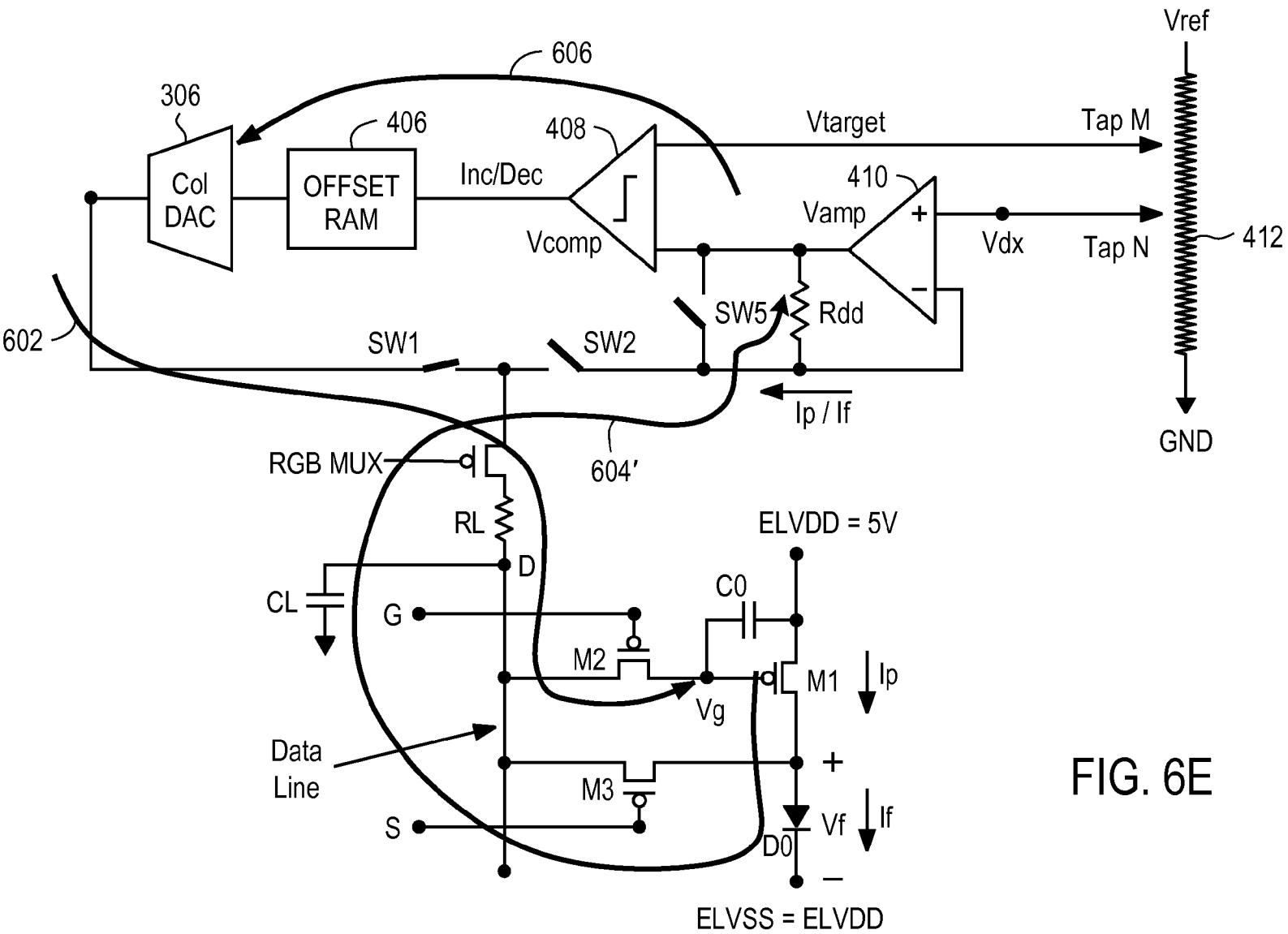

As can be seen from the above and further illustrated in FIG. 6E, Mura calibration according to the present invention uses discrete time feedback. Column DAC 306 voltage drives the gate voltage Vg of TFT M1 via path 602, and voltage Vg determines pixel transistor current Ip. Pixel transistor current Ip determines the output voltage Vamp of amplifier 410 via path 604', and the voltage Vamp drives an input to comparator 408. Comparator 408 drives offset RAM 406, whose data is added to the average RGB data, and then this sum is applied to the digital input of the column DAC 306. The feedback loop 602, 604', 606 improves calibration cell accuracy by cancelling out offsets, gain errors, and non-linearities during Mura calibration.

Figure 7:
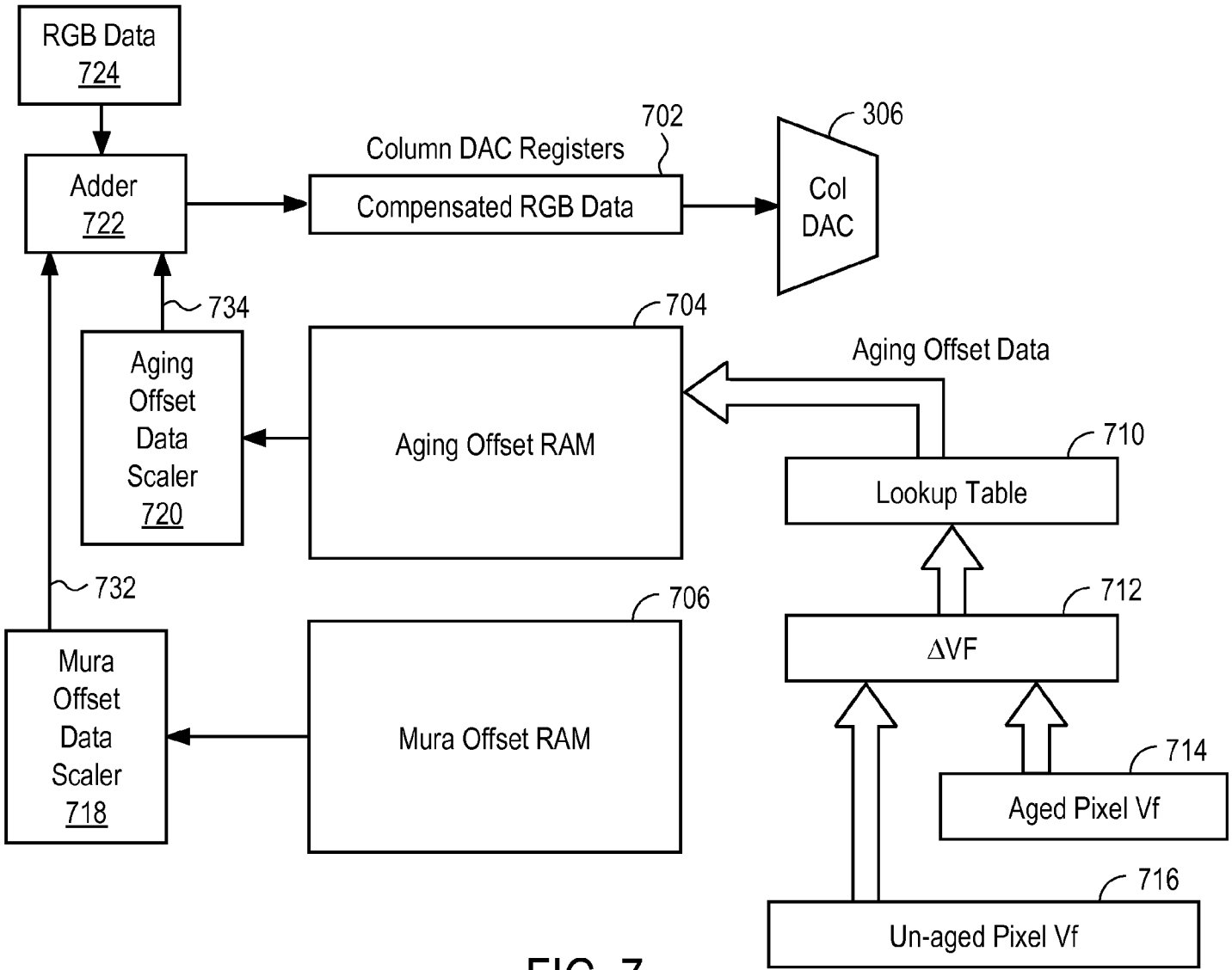
FIG. 7 illustrates the addition of compensation data to real-time display data, according to one embodiment of the present invention.

FIG. 7 illustrates the generation of compensated RGB data that is held in column DAC register 702 which drives the column DAC 306 for real-time display by adding the scaled Mura and image sticking (aging) offset data to the RGB data in real time, according to one embodiment of the present invention. The Mura offset RAM 706 and the aging offset RAM 704 store offset values for correction of the DAC data in order to compensate for Mura and aging, respectively, in the AMOLED display. The offset data for age (image sticking) compensation may be determined in a variety of ways, which are not the subject of the invention herein and are not described herein. Data in the Mura offset RAM 704 are entered through the Mura calibration process described above with reference to FIGS. 6A-6E.

For aging compensation, the un-aged OLED diode forward voltage Vf(un-aged) 716 (shown as "Un-aged Pixel Vf" in FIG. 7) of each sub-pixel for un-aged sub-pixels conducting a predetermined constant OLED diode current (Itarget) may be compared with the forward voltage Vf(aged) 714 (shown as "Aged Pixel Vf" in FIG. 7) of aged OLED diodes needed to have the same predetermined constant OLED diode current (Itarget) flow in aged OLED diodes, to determine a difference ΔVF 712 in such forward voltages and infer how aged the OLED diode is. The forward voltage difference ΔVF 712 is used as an index into a look-up table 710 that stores factory-determined full-scale aging offset data needed to compensate for such aging in the OLED diodes as a function of the inferred age of the OLED diode. Such aging offset data is stored in the aging offset RAM 704 at a location corresponding to the calibrated sub-pixel.

The data stored for each sub-pixel in the offset RAMs 704 and 706 corresponds to the correction needed for full-scale pixel current (e.g., Ip=200 nA) which corresponds to a full-scale RGB data (also equal to the "average RGB data"). For real-time display, the data in the offset RAMs 704 and 706 should be scaled according to the real-time RGB data so that full-scale offsets are scaled accordingly for less than full-scale RGB input data. Mura offset data scaler 718 and aging offset data scaler 720 scale the full-scale Mura offset data and the full-scale aging offset data, respectively, to correspond to the real-time RGB data 724 for the driven sub-pixel. Adder 722 performs real-time addition of the scaled Mura offset value 732 and the scaled aging (image sticking) offset value 734 to the real-time RGB data 724 corresponding to the driven sub-pixel, and the summed result is stored temporarily in column DAC registers 702 as compensated RGB data for driving the column DAC 306 that subsequently drives the sub-pixel for real-time display.

Note that unwanted external noise is present in the OLED display panel 200. As can be seen from FIGS. 4 and 6A-6E, the calibration cell of FIGS. 4 and 6A-6E use a single-sided transresistance amplifier 410, in that amplifier 410 generates a single signal that contains both the pixel current signal and also associated panel noise. This approach results in amplifier 410 amplifying the associated panel noise as well as the pixel current signal in the OLED pixel to be calibrated.

Figure 8:
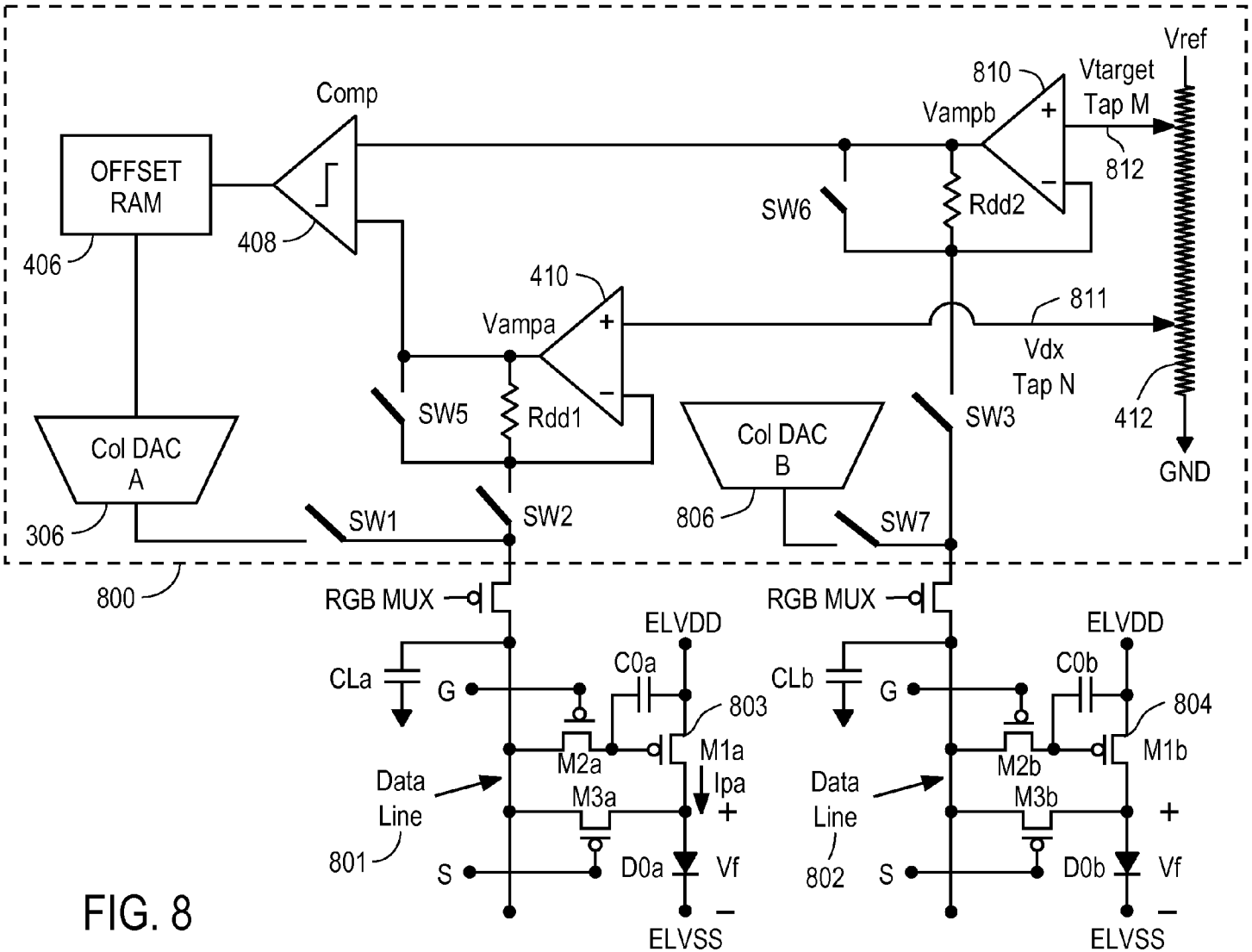
FIG. 8 illustrates the circuitry of the EPIC DDI using a differential transresistance amplifier Mura calibration cell, according to another embodiment of the present invention.

FIG. 8 illustrates the circuitry of the EPIC DDI using a differential transresistance amplifier Mura calibration cell, according to another embodiment of the present invention. The calibration cell 800 shown in FIG. 8 uses a differential transresistance amplifier comprised of two amplifiers, Vampa 410 and Vampb 810. In other words, the calibration cell 800 shown in FIG. 8 is substantially same as the calibration cell 300 shown in FIGS. 4 and 6A-6E, except that it additionally includes the second amplifier circuitry comprised of amplifier Vampb 810, resistor Rdd2, switch SW6, column DAC B 806, and switch SW7, sensing noise current from an adjacent data line B 802 adjacent to data line A 801 for Mura calibration. Voltage Vdx at tap N of resistor string 412 is provided to the positive input of amplifier Vampa 410. On the other hand, the target voltage Vtarget at tap M of resistor string 412 is provided to the positive input of amplifier Vampb 810, rather than directly to one input of comparator Comp 408. The benefit of this approach is noise cancellation, as explained in more detail below.

Noise in the OLED panel 200 is present in nearly equal amounts on all data lines of the OLED panel 200. Noise current is coupled in equal amounts to data line A 801 and data line B 802 by capacitors CLa and CLb, respectively. During Mura calibration, the gate voltage of pixel transistor M1*a* 803 is driven by column DAC A 306 which generates a pixel current Ipa through transistor M1*a* 803 that is sensed by amplifier Vampa 410. The output of amplifier Vampa 410 is a voltage representing the pixel current through transistor M1*a* 803 as well as noise. Column DAC B 806 simultaneously drives the gate voltage of the sub-pixel transistor M1*b* 804 such that the current of sub-pixel transistor M1*b* is zero. The sub-pixel transistor M1*b* 804 is on the same row as the sub-pixel transistor M1*a*, but is connected to an adjacent data line B 802. Since pixel current of transistor M1*b* is driven to zero, only noise current is sensed through data line B 802 across resistor Rdd2 at the output of amplifier Vampb 810, and absent the noise current, the output voltage Vampb is equal to the voltage Vtarget. Thus, amplifier Vampb 810 amplifies only the noise present on data line B 802. Since noise components on data line B 802 and data line A 801 are substantially equal, the output voltages of both amplifiers Vampa 410 and Vampb 810 have the same noise voltages. Comparator Comp 408 rejects (cancels out) this noise, because it is common-mode noise (present in equal amounts at each input of comparator Comp 408). Therefore the differential transresistance amplifier comprised of the two amplifiers 410, 810 has the benefit of rejecting unwanted external noise in the OLED display 200 during pixel current measurement of the Mura-calibrated sub-pixel.

More specifically, the 3T OLED pixel to be Mura-calibrated is connected to data line A 801 and includes OLED D0*a*, capacitor C0*a*, and transistors M1*a* 803, M2*a*, and M3*a*. Another 3T OLED pixel is connected to data line B 802 adjacent to data line A 801 on the same row, and includes OLED D0*b*, capacitor C0*b*, and transistors M1*b* 804, M2*b*, and M3*b*. The gate voltage of pixel transistor M1*a* 803 is controlled by column DAC A 306 via switch SW1, and the gate voltage of pixel transistor M1*b* 804 is controlled by column DAC B 806 via switch SW7.

Amplifier Vampa 410 forms a transresistance amplifier connected to data line A 801, senses pixel current Ipa through pixel transistor M1*a* 803 via data line A 801, and provides an output voltage Vampa proportional to such pixel current through pixel transistor M1*a* 803. Similarly, amplifier Vampb 810 forms another transresistance amplifier connected to data line B 802, senses pixel current through pixel transistor M1*b* 804 via data line B 802, and provides an output voltage Vampb proportional to such pixel current through pixel transistor M1*b* 804. However, for Mura calibration, this pixel current in the adjacent pixel through pixel transistor M1*b* is set to zero by column DAC B 806. Therefore the output of amplifier Vampb 810 is ideally equal to Vtarget, if noise were not present. The voltage Vdx 811 at Tap N of resistor string 412 sets the bias voltage of data line A 801 to an appropriate value for sensing the pixel current Ipa over the required voltage range. The voltage Vtarget 812 is set by Tap M of resistor string 412 to the value representing the target pixel current of pixel transistor M1*a* 803. If the pixel current Ipa through pixel transistor M1*a* is same as the target current set by the voltage Vtarget, the outputs of amplifier Vampa 410 and Vampb 810 would be equal and the comparator 408 would be at its switching point.

When no external panel noise is present, the output voltage Vamp of amplifier Vampb 810 would be exactly equal to Vtarget because the pixel current through M1*b* 804 on data line B 802 is zero. In this condition, the voltage input to the comparator 408 is the same for the differential transresistance amplifier of FIG. 8 as for the single ended transresistance amplifier of FIGS. 6A-6E. The process of Mura calibration then results in a feedback convergence as previously described above with reference to FIGS. 6A-6E. At the end of the calibration cycle, the offset RAM 406 (more specifically, Mura offset RAM 706) contains the proper offset to the RGB value that provides the gate voltage that exactly produces the pixel current value Itarget that corresponds to the voltage Vtarget.

However, when noise is present in the OLED panel 200 noise, the data line A 801 and the data line B 802 pickup equal or nearly equal noise voltages. These noise voltages are amplified by both amplifier Vampa 410 and Vampb 810, which drive equally amplified noise voltages on each input of comparator Comp 408. Since the comparator 408 is designed with good rejection of such common mode signals, the noise is rejected. Thus, the calibration cell 800 of FIG. 8 allows superior detection of small pixel currents and more accurate Mura calibration without adverse effects from noise present in the AMOLED panel. Although the example in FIG. 8 illustrates the situation where amplifier Vampb 810 is connected to a sub-pixel on a data line adjacent to that of the sub-pixel to be calibrated for Mura, amplifier Vampb 810 could be connected to non-adjacent data lines, since noise in the OLED sub-pixels is generally at the same level from data line to data line.

The process for Mura calibration using the calibration cell of FIG. 8 is substantially the same as the process for Mura calibration using the calibration cell described above with reference to FIGS. 6A-6E, except that the voltage Vtarget is augmented with the noise voltage amplified by amplifier Vampb 810 connected to the adjacent data line B 802 on the same row as transistor M1*a* 803, for comparison with the output voltage Vampa of amplifier Vampa 410 reflecting the pixel current through pixel transistor M1*a*. Specifically, the first step of Mura calibration using the calibration cell of FIG. 8 is to store an average RGB value on the pixel storage capacitors C0*a* of the OLED pixel to be calibrated. Again, the "average RGB value" is the analog equivalent of the "average RGB data" (when converted to analog) which produces a pixel transistor current equal to Itarget (e.g., 200 nA) in all pixels, which could have been measured in the factory empirically. Loading such average RGB value onto the OLED pixels prior to Mura calibration reduces the time required for Mura calibration. The ELVSS pin is set to ELVDD for Mura calibration operations to ensure that the OLEDs D0*a*, D0*b* are turned off. Tap N of resistor string 412 is set to a nominal data line voltage (+2V) at Vdx 811 for pixel transistor current measurement for Mura calibration operations.

Then, the "average RGB data" is loaded into column DAC A 306 (for the 1st bit of Mura offset calibration), and the offset RAM 406 value is set to zero (0) only for the 1st bit of the Mura calibration offset value of a pixel that is being calibrated. For all other bits of Mura calibration, the offset RAM 406 will begin with the previous value set during calibration of the previous bit. Also, zero RGB data is loaded onto the column DAC B 806 of the OLED pixel coupled to the adjacent data line on the same row as the OLED pixel to be calibrated. Thereafter, switches SW1, SW5, SW6, and SW7 are closed but switches SW2 and SW3 are open. Also, TFT M3*a* is turned off, TFT M2*a* is turned on, TFT M3*b* is turned off, and TFT M2*b* is turned on. Then, the RGB MUX for both pixels is selected to connect the corresponding column to one of the three data lines connected to the sub-pixel that is to be calibrated. Note that this step of selecting the RGB MUX is performed because there are 3 sub-pixels each corresponding to colors R, G, B, in a pixel, but does not directly affect the calibration process. For the purposes of illustration of Mura calibration according to the present invention, each sub-pixel may be treated like a single, independent OLED pixel.

Next, since TFT M2*a* is on, the column DAC A 306 voltage (which is set to the average RGB value) applied to the connected data line A 801 is also applied as the gate voltage Vg to TFT M1*a*, and the voltage Vg settles on data line A 801. Similarly, the zero RGB data on column DAC B 806 also settles as zero gate voltage on data line B 802. Then, TFT M2*a* and TFT M2*b* are turned off, and the pixel voltage corresponding to the voltage Vg settles on storage capacitor C0*a* and zero voltage settles on storage capacitor C0*b* in the adjacent OLED sub-pixel. As a result, charges corresponding to the average RGB value are stored in the pixel storage capacitor C0*a* of the calibrated sub-pixel, while no charges are stored in the pixel storage capacitor C0*b* of the adjacent sub-pixel.

The second step of Mura calibration is to pre-charge the data line A 801 to the voltage Vdx set by Tap N of the resistor string 412. To this end, TFT M2*a* is turned off, switch SW1 is opened, and switches SW2 and SW5 are closed. Also, TFT M3*a* is turned on by applying a turn-on voltage to the gate of TFT M3*a* on the sense line S. Closing switch SW5 forces the voltage on data line A 801 to settle quickly to Vdx. Vdx=2V for bias voltage optimization. Similarly, TFT M2*b* is turned off, switch SW7 is opened and switches SW3 and SW6 are closed. Also, TFT M3*b* is turned on by applying a turn-on voltage to the gate of TFT M3*b* on the sense line S. Next, voltage Vtarget is set to Vtarget=Vdx−Itarget×Rdd where Itarget=200 nA (for example). Closing switch SW6 forces the voltage on data line B 802 to quickly settle to Vtarget.

The third step of Mura calibration is to measure the pixel transistor current and determine the 1st bit of the offset RAM 406 value for calibration based on the measured pixel transistor current, as shown in FIG. 8. To this end, switch SW5 is opened, which causes the pixel transistor current Ipa to flow from TFT M1*a*, through TFT M3*a*, on data line A 801, and through resistor Rdd1. The output voltage Vampa of amplifier 410 becomes Vampa=Vdx−(Ipa+Ina)×Rdd2, where Ipa is the pixel transistor current through TFT M1*a* and Ina is the current reflecting the noise on data line A 801 of the calibrated pixel. The larger the pixel transistor current Ipa and the noise current Ina, the smaller the output voltage Vamp of amplifier 410. Similarly, current Inb reflecting noise in the adjacent data line B containing TFT M1*b* would be present, and the output voltage Vampb of amplifier 801 becomes Vampb=Vtarget−(Inb)×Rdd2, since the pixel current through TFT M1*b* is zero. The resistance value of resistor Rdd1 may be same as the resistance value of resistor Rdd2.

Using Comp to denote the logical output of comparator 408, if Comp=0, then Vampb>Vampa, which means the pixel transistor current Ipa is larger than the desired current Itarget as represented by the voltage Vtarget and thus the strobed or clocked comparator 408 decrements the offset value ($1^{st}$ bit) in offset RAM 406. If Comp=1, then Vampb<Vampa, which means the pixel transistor current Ipa is smaller than the desired current Itarget as represented by the voltage Vtarget and thus the strobed or clocked comparator 408 increments the offset value ($1^{st}$ bit) in offset RAM 406. This comparison process by comparator 408 occurs once per each bit of the offset value. As a result, the offset RAM 406 contains the value of the 1st bit of Mura calibration (this value can be positive or negative). Note that the noise voltage components in Vampa and Vampb reflecting the noise current Ina and Inb in the two adjacent pixels are canceled out by the comparator 408. Thus, the calibration cell 800 is able measure the pixel current Ipa much more accurately for Mura calibration. The increments or decrements that occur during each bit comparison could either be unity in the case of a linear analog-to-digital converter or binary as in the case of a SAR analog-to-digital converter.

The next step of Mura calibration is to add the average RGB data to the offset RAM 406 data and to apply this sum to the column DAC A 306 digital input. This action changes the DAC A 306 output and this new value is then transferred onto the storage capacitor C0*a* of the OLED sub-pixel to be calibrated. The second bit of the offset value for Mura calibration can now be determined. The updated column DAC A 306 value (reflecting the $1^{st}$ bit of the offset RAM 406 data added to the average RGB data) is loaded onto storage capacitor C0*a*, by turning TFT M3*a* off and TFT M2*a* on, closing switches SW1 and SW5 and opening switch SW2, and selecting the same RGB MUX (for the same pixel). As a result, the modified column DAC 306 voltage quickly settles on the data line A 801, is applied as the gate voltage Vg of TFT M1*a*, and is stored in the storage capacitor C0*a*. Since the current in data line B 802 remains zero, it is not necessary to change switch setting. Switches SW7 and SW6 remain open and switch SW3 remains closed. Then, TFT M2*a* is turned off. Then, the same processes as explained above are performed to sense the pixel transistor current Ipa and determine the second bit of the offset RAM 406 value for Mura calibration.

The processes described are repeated to obtain the subsequent bits of the offset RAM 406 data until the maximum number of bits of the offset RAM for Mura calibration are determined (for SAR search) or the number of times that comparator 406 switches reaches a preset limit (for proximity search, which is a linear sequential search). Such final value of the offset RAM 406 is stored in the Mura offset RAM (706 in FIG. 7) location for the 1st pixel, and as a result the 1st pixel Mura calibration is complete. Then, staying on the same row, the same calibration process as described above is repeated, traversing across the same row as in the first calibrated pixel, until all pixels in that row have been calibrated and their offsets are stored into their corresponding locations in the offset RAM 706. Then, the same calibration process as described above is repeated, proceeding to the next row and so on, until all pixels in all rows have been calibrated for Mura or streaking. As a result, Mura calibration is complete, and ELVSS and ELVDD voltages are reset for normal operation of the AMOLED display. Either successive approximation (SAR search) or linear search could be used during calibration.

Upon reading this disclosure, those of skill in the art will appreciate still additional alternative designs for Mura compensation in AMOLED displays. Thus, while particular embodiments and applications of the present invention have been illustrated and described, it is to be understood that the invention is not limited to the precise construction and components disclosed herein and that various modifications, changes and variations which will be apparent to those skilled in the art may be made in the arrangement, operation and details of the method and apparatus of the present invention disclosed herein without departing from the spirit and scope of the present invention.

What is claimed is:

1. An active matrix organic light-emitting diode (AMOLED) display device, comprising:

a plurality of sub-pixels arranged in rows and columns, each sub-pixel including at least an organic light-emitting diode (OLED), a first transistor for driving the OLED, a storage capacitor for turning on or off the first transistor according to charges stored in said storage capacitor, and a second transistor for connecting a data line of said each sub-pixel to the storage capacitor and the first transistor; and calibration circuitry configurable to be coupled to at least one of the sub-pixels and adapted to sense pixel transistor current through the first transistor in said one of the sub-pixels, the calibration circuitry forming part of a feedback loop forcing the sensed pixel transistor current to converge to a predetermined target current, wherein said each AMOLED sub-pixel further includes a third transistor connecting the data line with a node between the OLED and the first transistor, wherein the calibration circuitry comprises a first transresistance amplifier, a comparator, a memory, and a column digital-to-analog converter (DAC), wherein the first transresistance amplifier is configured to receive a first pixel transistor current from said one of the sub-pixels via the third transistor and the data line, and to generate a first output voltage based on the first pixel transistor current, wherein the comparator is configured to receive the first output voltage from the first transresistance amplifier, to compare the first output voltage to a first predetermined voltage corresponding to the predetermined target current, and to generate a second output voltage based on the comparison, wherein the memory is configured to store an offset value based on the second output voltage, and wherein the column DAC is configured to generate a second pixel transistor current based on display data and the offset value stored in the memory, and to transmit the second pixel transistor current to the second transistor of said one of the sub-pixels via the data line.

2. The AMOLED display device of claim 1, wherein the feedback loop forces the sensed pixel transistor current in each of the plurality of sub-pixels to be substantially equal to the predetermined target current, notwithstanding non-uniformity of transistors in the AMOLED sub-pixels.

3. The AMOLED display device of claim 1, wherein the comparator is configured to increase the offset value to be combined with the display data for said one of the sub-pixels responsive to a first comparison state corresponding to when the first output voltage of the first transresistance amplifier exceeds the first predetermined voltage, wherein the comparator is configured to decrease the offset value responsive to a second comparison state corresponding to when the first output voltage of the first transresistance amplifier is less than the first predetermined voltage, and wherein the sensed pixel transistor current converges to the predetermined target current when the comparator switches from the first comparison state to the second comparison state or from the second comparison state to the first comparison state.

4. The AMOLED display device of claim 3, wherein the calibration circuitry further includes:

a second transresistance amplifier configured to sense noise voltage on another data line in another sub-pixel different from said one of the sub-pixels, wherein the comparator is configured to compare the first output voltage of the first transresistance amplifier with an output voltage of the second transresistance amplifier, the output voltage of the second transresistance amplifier corresponding to the first predetermined voltage combined with the sensed noise, wherein the comparator is configured to increase the offset value responsive to the first comparison state corresponding to when the first output voltage of the first transresistance amplifier exceeds the output voltage of the second transresistance amplifier, wherein the comparator is configured to decrease the offset value responsive to the second comparison state corresponding to when the first output voltage of the first transresistance amplifier is less than the output voltage of the second transresistance amplifier, and wherein the sensed pixel transistor current converges to the predetermined target current when the comparator switches from the first comparison state to the second comparison state or from the second comparison state to the first comparison state.

5. The AMOLED display device of claim 4, wherein said another sub-pixel is on a same row as said one of the sub-pixels and is connected to another data line adjacent to said data line of said one of the sub-pixels.

6. The AMOLED display device of claim 4, wherein the comparator rejects common mode noise in both the first output voltage of the first transresistance amplifier and the output voltage of the second transresistance amplifier.

7. The AMOLED display device of claim 4, wherein the first transresistance amplifier and the second transresistance amplifier form a differential amplifier.

8. The AMOLED display device of claim 4, wherein the second transresistance amplifier includes:

a first input coupled to the first predetermined voltage;

a second input configurable to be coupled to said another data line;

an output coupled to the comparator; and a second resistor coupled between the output of the second transresistance amplifier and the second input of the second transresistance amplifier.

9. The AMOLED display device of claim 1, further comprising a multiplexer configured to connect the data line to the column DAC or to the calibration circuitry.

10. The AMOLED display device of claim 1, wherein the first transresistance amplifier includes:

a first input coupled to a second predetermined voltage;

a second input configurable to be coupled to the data line;

an output coupled to the comparator; and a first resistor coupled between the output of the first transresistance amplifier and the second input of the first transresistance amplifier, and wherein the first output voltage of the first transresistance amplifier is proportional to the pixel transistor current sensed across the first resistor.

11. The AMOLED display device of claim 10, wherein both the first predetermined voltage and the second predetermined voltage are generated by a first tap and a second tap, respectively, of a resistor string coupled to a reference voltage and including a plurality of taps corresponding to gray scales of the AMOLED display device.

12. A method of compensating for non-uniformity in transistors of a plurality of sub-pixels of an active matrix organic light-emitting diode (AMOLED) display device, wherein the display device comprises a plurality of sub-pixels arranged in rows and columns, each sub-pixel including at least an organic light-emitting diode (OLED), a first transistor for driving the OLED, a storage capacitor for turning on or off the first transistor according to charges stored in said storage capacitor, and a second transistor for connecting a data line of said each sub-pixel to the storage capacitor and the first transistor, wherein the display device further comprises calibration circuitry configurable to be coupled to at least one of the sub-pixels and adapted to sense pixel transistor current through the first transistor in said one of the sub-pixels, the calibration circuitry forming part of a feedback loop forcing the sensed pixel transistor current to converge to a predetermined target current, wherein said each AMOLED sub-pixel further includes a third transistor connecting the data line with a node between the OLED and the first transistor, wherein the calibration circuitry comprises a first transresistance amplifier, a comparator, a memory, and a column digital-to-analog converter (DAC), the method comprising:

receiving, by the first transresistance amplifier, a first pixel transistor current from said one of the sub-pixels via the third transistor and the data line, and generating a first output voltage based on the first pixel transistor current;

receiving, by the comparator, the first output voltage from the first transresistance amplifier, comparing the first output voltage to a first predetermined voltage corresponding to the predetermined target current, and generating a second output voltage based on the comparison;

storing, by the memory, an offset value based on the second output voltage; and generating, by the column DAC, a second pixel transistor current based on display data and the offset value stored in the memory, and transmitting the second pixel transistor current to the second transistor of said one of the sub-pixels via the data line.

13. The method of claim 12, further comprising pre-charging the data line to a second predetermined voltage, prior to the receiving the first pixel transistor current.

14. The method of claim 12, further comprising driving the second transistor with average RGB data corresponding to an average of RGB data that produces pixel transistor current equal to the predetermined target current in said plurality of sub-pixels, prior to the receiving the first pixel transistor current.

15. The method of claim 12, wherein the generating the second output voltage comprises increasing the offset value to be combined with the display data for said one of the sub-pixels responsive to a first comparison state corresponding to when the first output voltage exceeds the first predetermined voltage, wherein the generating the second output voltage comprises decreasing the offset value responsive to a second comparison state corresponding to when the first output voltage is less than the first predetermined voltage, and wherein the sensed pixel transistor current converges to the predetermined target current responsive to switching from the first comparison state to the second comparison state or from the second comparison state to the first comparison state.

16. The method of claim 15, further comprising:

sensing noise voltage on another data line in another sub-pixel different from said one of the sub-pixels, wherein the comparing comprises comparing the first output voltage to a combined voltage combining the first predetermined voltage with the sensed noise voltage, wherein the increasing the offset value comprises increasing the offset value responsive to the first comparison state corresponding to when the first output voltage exceeds the combined voltage, wherein the decreasing the offset value comprises decreasing the offset value responsive to the second comparison state corresponding to when the first output voltage is less than the combined voltage, and wherein the sensed pixel transistor current converges to the predetermined target current responsive to switching from the first comparison state to the second comparison state or from the second comparison state to the first comparison state.

17. The method of claim 16, wherein said another sub-pixel is on a same row as said one of the sub-pixels and is connected to another data line adjacent to said data line.

18. The method of claim 16, wherein common mode noise in both the first output voltage and the combined voltage is rejected.

19. The method of claim 12, wherein the method is repeated for all sub-pixels of the AMOLED display device.

20. The method of claim 12, wherein the OLED of said one of the sub-pixels is turned off while the first pixel transistor current is received.

* * * * *